US009541272B2

(12) United States Patent
Burmeister et al.

(10) Patent No.: US 9,541,272 B2
(45) Date of Patent: Jan. 10, 2017

(54) EXPLOSION-PROOF LED MODULE

(75) Inventors: Jens Burmeister, Eberbach (DE); Bernd Schwarz, Eberbach (DE); Gerhard Schwarz, Schönbrunn (DE); Michael Ketterer, Soest (DE)

(73) Assignee: COOPER CROUSE-HINDS GMBH, Soest (DE)

( * ) Notice: Subject to any disclaimer, the term of this patent is extended or adjusted under 35 U.S.C. 154(b) by 179 days.

(21) Appl. No.: 14/111,761

(22) PCT Filed: Apr. 4, 2012

(86) PCT No.: PCT/EP2012/001496
§ 371 (c)(1),
(2), (4) Date: Mar. 28, 2014

(87) PCT Pub. No.: WO2012/139728
PCT Pub. Date: Oct. 18, 2012

(65) Prior Publication Data

US 2014/0204570 A1 Jul. 24, 2014

(30) Foreign Application Priority Data

Apr. 15, 2011 (DE) ..... 10 2011 017 162

(51) Int. Cl.
*F21V 25/12* (2006.01)
*F21V 29/70* (2015.01)
(Continued)

(52) U.S. Cl.
CPC ..... *F21V 25/12* (2013.01); *F21S 4/008* (2013.01); *F21S 4/28* (2016.01); *F21V 3/00* (2013.01);
(Continued)

(58) Field of Classification Search
CPC ..... F21V 17/101; F21V 17/164; F21V 25/12; F21V 31/04; F21V 17/06; F21V 17/10; F21V 17/18; F21V 29/503; F21V 29/70; F21V 29/713; F21V 29/74; F21V 29/745; F21V 29/76; F21V 29/767; F21V 3/02; F21S 4/008; F21S 4/28; F21Y 2103/003; F21Y 2103/00; F21Y 2103/10; F21W 2131/305
See application file for complete search history.

(56) References Cited

U.S. PATENT DOCUMENTS 2,215,900 A * 9/1940 Bitner ..... 362/309
2005/0265019 A1* 12/2005 Sommers et al. ..... 362/217
(Continued)

FOREIGN PATENT DOCUMENTS

CN 201166338 12/2008
DE 20 2008 010 175 12/2008
(Continued)

OTHER PUBLICATIONS

Definition of module, retrieved from dictionary.reference.com on Jan. 19, 2016.*
(Continued)

*Primary Examiner* — Anh Mai
*Assistant Examiner* — Steven Horikoshi
(74) *Attorney, Agent, or Firm* — King & Spalding LLP

(57) ABSTRACT

An explosion-proof LED module has at least one light-emitting diode, a heat sink connected to this and an LED cover that covers the LED at least in the emission direction. The LED cover extends into an insertion recess of the heat sink. In this insertion recess, the LED cover is surrounded by a casting compound resulting in sealing of the LED relative to an outer and possibly explosive atmosphere. As a result, an explosion-proof LED module can be provided whereby the manufacture of said explosion-proof LED module is relatively simple and possible in an economic manner in a
(Continued)

short time from prefabricated parts. At the same time, the explosion-proof module is furthermore characterized in that sufficient cooling corresponding to the ignition protection type "intrinsic safety" and an embedding of the component according to ignition protection type "encapsulation" are given.

15 Claims, 3 Drawing Sheets

(51) Int. Cl.

| | |
|---|---|
| ***F21S 4/00*** | (2016.01) |
| ***F21V 3/00*** | (2015.01) |
| ***F21V 5/04*** | (2006.01) |
| ***F21V 17/16*** | (2006.01) |
| ***F21V 29/00*** | (2015.01) |
| ***F21V 31/04*** | (2006.01) |
| ***F21V 29/71*** | (2015.01) |
| ***F21V 29/76*** | (2015.01) |
| *F21Y 101/00* | (2016.01) |

(52) U.S. Cl.
CPC ..... *F21V 5/04* (2013.01); *F21V 17/164* (2013.01); *F21V 29/004* (2013.01); *F21V 29/70* (2015.01); *F21V 29/713* (2015.01); *F21V 29/76* (2015.01); *F21V 31/04* (2013.01); *F21Y 2101/00* (2013.01); *F21Y 2103/10* (2016.08); *F21Y 2115/10* (2016.08)

(56) References Cited

U.S. PATENT DOCUMENTS

| | | | | |
|---|---|---|---|---|
| 2006/0227558 | A1 | 10/2006 | Osawa et al. | |
| 2009/0019873 | A1* | 1/2009 | Koike et al. | 62/248 |
| 2010/0026185 | A1* | 2/2010 | Betsuda et al. | 315/32 |
| 2010/0232155 | A1 | 9/2010 | Wang | |
| 2011/0157901 | A1* | 6/2011 | Chen | 362/373 |
| 2012/0008314 | A1* | 1/2012 | Simon | F21K 9/17 362/217.1 |
| 2012/0127733 | A1* | 5/2012 | Tomiyoshi et al. | 362/363 |

FOREIGN PATENT DOCUMENTS

| | | |
|---|---|---|
| DE | 10 2007 040 272 | 2/2009 |
| EP | 1630475 | 3/2006 |
| GB | 2 428 467 | 1/2007 |
| GB | 2 458 345 | 9/2009 |
| JP | 2010-033757 | 2/2010 |
| JP | 2011-060428 | 3/2011 |
| WO | WO 2011001605 A1 * | 1/2011 |

OTHER PUBLICATIONS

Translation of Chinese Office Action, Application No. 201280026897.4, Aug. 21, 2015, 5 pages, The State Intellectual Property Office of the People's Republic of China.

Translation of Office Action issued by the Patent Office of the Russian Federation, Federal Institute of Industrial Property, Office Action issued in Russian Patent Application No. 2013147916/07(074515), Feb. 20, 2015, 2 pages, Moscow, Federal Institute of Industrial Property.

Translation of Office action issued by the Korean Intellectual Property Office, Office Action issued in Korean Patent Application No. 10-2013-7029060, Feb. 27, 2015, 7 pages, The Patent Examination Bureau I of Korean Intellectual Property Office.

Translation of Office action issued by The Korean Intellectual Property Office, Office Action issued in Korean Patent Application No. 10-2013-7029060, Nov. 26, 2015, 5 pages, The Patent Examination Bureau I of Korean Intellectual Property Office.

Machine translation of JP 2011-060428, via Lexis Nexis Total Patents, 8 pages.

Translation of Office action issued by The Korean Intellectual Property Office, Office Action issued in Korean Patent Application No. 10-2015-7030457, Jul. 29, 2016, 5 pages, The Patent Examination Bureau I of Korean Intellectual Property Office.

* cited by examiner

EXPLOSION-PROOF LED MODULE

RELATED APPLICATIONS

This application is a Section 371 national phase application of and claims priority to PCT application PCT/EP2012/001496 filed on Apr. 4, 2012, which claims priority to German Patent Application Number 10 2011 017 162.2 filed on Apr. 15, 2011, the contents of which are incorporated herein in their entirety.

BACKGROUND

Various lamps that are formed according to corresponding ignition protection types are known for explosion-proof areas. For light-emitting diodes (LED), for example, it is known to operate them with ignition protection type Ex-i. This means that the LED is supplied via an intrinsic safety barrier which limits current/voltage to the point that neither the ignition power nor ignition temperature is reached for an explosive mixture. As a rule, the maximum surface temperature of the corresponding component is also limited.

Furthermore, LEDs are known that are executed according to ignition protection type Ex-m "encapsulation". This means that at least parts of the LED that could be ignition sources for a corresponding explosive mixture are embedded in a casting compound. As a result, a corresponding electric arc cannot penetrate through to the explosive mixture outside the encapsulation.

SUMMARY

The basis of the present invention is the object of providing an explosion-proof LED module whereby the manufacturing of said explosion-proof LED module is relatively simple and possible in an economic manner in a short time from prefabricated parts. At the same time, the explosion-proof LED module is furthermore characterized in that sufficient cooling corresponding to the ignition protection type "intrinsic safety" and an embedding of the component according to ignition protection type "encapsulation" are given.

The solution according to the invention is characterised by the fact that the explosion-proof LED module has at least a light-emitting diode LED, a heat sink connected to this LED and an LED cover that covers the LED at least in the emission direction, whereby this LED cover extends into an insertion recess of the heat sink and is surrounded by a casting compound in this insertion recess resulting in sealing of the LED relative to an external and possibly explosive atmosphere.

Such an explosion-proof LED module is simple to manufacture and has various merits that otherwise are known only for the implementation of various ignition protection types separately, see the above remarks.

Directly sealed LEDs do not have to be used, whereby at the same time, the space surrounding the LED is relatively small due to the use of the casting compound, heat sink with insertion recess and LED sealing. Sufficient cooling of the LED is given, and a penetration of an electric arc to the outside in a possibly explosive mixture is reliably prevented.

A corresponding explosion-proof LED module can be formed with only one light-emitting diode, optionally on an LED board, and the corresponding parts. In order to be able to combine a plurality of LEDs on a modular basis, a corresponding LED board can be used on which a plurality of LEDs are arranged in the board's longitudinal direction, for example, next to one another and spaced a distance apart from one another. Such LED boards are known per se and can be manufactured in different lengths and widths as needed. It is likewise possible to manufacture RGB boards or also flexible boards that can be adapted to the respective conditions optimally due to their bendability. In the case of such flexible boards, it furthermore proves to be advantageous that these can be processed simply and economically.

In the case of such boards it furthermore proves to be advantageous if a one-piece or multiple-piece LED cover is provided for all LEDs of such an LED board. As a result, there is no necessity to seal each LED by means of a separate LED cover and corresponding casting compound.

The implementation of such an explosion-proof LED module with a plurality of LEDs is furthermore simplified if the heat sink is likewise formed for all LEDs of the LED board. This means only one heat sink on which, for example, the board with the LEDs is arranged directly is used. The heat sink can also be formed from multiple, particular identical, heat sink segments.

In order to be able to arrange the board in a simple and reliable way on the heat sink, particularly with respect to the casting with the casting compound, the heat sink can have at least one inlay recess running in the heat sink's longitudinal direction, whereby the LED board is laid on to a cooling surface in this inlay recess. The cooling surface can have dimensions that correspond to the board, see length and width.

It is of course also possible that the board or cooling surface has dimensions that are larger in the length or width than the dimensions of the respective other part.

For better heat transfer between the cooling surface, and consequently the heat sink, and the LED board, a corresponding heat conducting foil can be applied either to the cooling surface or to the board.

In order to allow the attachment of the LED cover, particularly in the case that it is executed in one piece, in a simple manner for a plurality of LEDs, the cooling surface can be encircled by the insertion recess in the heat sink's longitudinal direction on both sides, at least in places.

In the case of one embodiment it is, for example, possible that the insertion recesses extend to the cooling surface at least along the cooling surface on both sides. It is furthermore possible that the insertion recess is also present on the longitudinal ends of the cooling surface so that this recess essentially completely encircles the cooling surface.

It is conceivable to attach the LED cover only by means of inlaying or inserting it into the insertion recess and subsequently casting with the casting compound in such a way that all LEDs are formed according to the required ignition protection type. However in order already to be able to fix the LED cover in place on the heat sink at least temporarily during the casting with the casting compound, the LED cover can have a number of insertion elements sticking out in the direction of the insertion recess for attachment on the heat sink.

A conceivable embodiment for such insertion elements can be seen therein if these are formed with latching elements which engage with counter-latching elements within the insertion recess. In this way, the LED cover can be latched into place on the heat sink after the arrangement of the LED board and production of the electrical supply of the board, whereby the casting compound is subsequently cast into the insertion recess in order, on the one hand, to fix the LED cover in place and, on the other hand, to produce the sealing of the LEDs relative to the surrounding atmosphere.

Various alternative attachment options are conceivable. For example, the LED board can be screwed to the heat sink. Then the protective cover or LED cover is put on and held in position, as well as cast. After the casting compound hardens, a corresponding holding device for the cover is removed and the cover is then held only by means of the casting compound.

In order to be able to match the corresponding latching elements to the counter-latching elements in a simple way, in one embodiment a latching recess that sticks out essentially perpendicularly to the heat sink's longitudinal direction and that extends along the insertion recess can be formed. This means that no exact matching between the latching element and the counter-latching element is necessary, and a displacement of the LED cover after the engagement of the latching elements into the latching recess is even possible. However in order optionally to allow a matching of LEDs and LED cover in a certain manner, a corresponding counter-latching element can be provided for each latching element, whereby each such counter-latching element is formed only by a corresponding latching recess that is formed essentially perpendicularly to the heat sink's longitudinal direction within the insertion recess.

In this connection, it is possible that the latching in place of the latching elements takes place outwards, away from the cooling surface or also inwards, towards the cooling surface. It is furthermore possible that the latching elements are arranged on both sides of the cooling surface in pairs, or also are offset with respect to one another.

In order to prevent the possibility that the casting compound, after it has hardened, can be pulled out together with the LED cover by means of a corresponding outside force effect on the LED cover, the insertion recess can have a varying cross-section and/or a direction-changing development in the direction of the counter-latching element.

This means that the cross-section of the insertion recess increases, for example, in the direction towards the latching recess. A further possibility can be seen in having the latching recess have a development that, for example, is formed in a wavelike manner, with a zigzag shape or the like in the direction of the counter-latching element.

In order to be able to seal the LED cover likewise on the ends of the LED boards by a corresponding application of the casting compound, a casting recess can be formed on each of the longitudinal ends of the LED board in the heat sink. This casting recess can be formed with the same depth as the insertion recess, but also with another depth. For example, it is possible that no more corresponding insertion elements are arranged in the area of the casting recess so that these insertion elements no longer have to be arranged in the casting compound, as a result of which the depth of the casting recess can be lower than that of the insertion recess.

In order to allow reliable sealing of the LED cover with the casting compound on the heat sink, the LED cover can have a circumferential edge, particularly around the entire circumference, protruding in the direction of the insertion recess or the casting recess. In the case of an LED cover that is arranged on the heat sink, this circumferential edge is arranged in the casting compound so that the sealing of the LEDs with respect to the outer atmosphere essentially takes place via the dipping of this circumferential edge into the casting compound.

It is possible that the insertion elements are formed separately from the circumferential edge and stick out from the rest of the LED cover in the direction of the insertion recess. In the case of a simple embodiment, the insertion elements can stick out from the circumferential edge.

It is conceivable that the LED cover has a uniform curvature in its longitudinal direction for holding all LEDs. It can, however, prove to be advantageous if the LED cover has LED hook-ups convexly curved away from the LEDs, whereby in particular each LED hook-up is assigned its own LED.

It is conceivable that the individual LED hook-ups are formed as a lens system for the LED or that they comprise such a system.

In the case of this assignment of LED hook-up to LED, the corresponding hook-up can also be formed as an optical element that, for example, determines the emission direction of the LED, that makes the emission of LEDs continuous so that the LEDs do not appear as punctiform light sources, etc.

Within the LED cover or hook-up, reflection devices can be provided that likewise serve to direct the light, or the cover or hook-up can have surface structures on the inside or outside that likewise influence the light emission or light intensity.

The length of such an LED module with LED board can approximately correspond to that of a tube-shaped fluorescent lamp so that the latter can be replaced with the LED module. In corresponding fluorescent lamps it is likewise known that a plurality, for example, two, are arranged one next to the other. This is likewise possible with the LED module according to the present invention in that the heat sink has, transverse to the heat sink's longitudinal axis, two lateral side ends that run tilted relative to a vertical, whereby an LED board with LED cover and casting compound is arranged on each of these side ends, i.e., each of these side ends forms a lamp similar to a fluorescent lamp so to speak.

It is possible to manufacture the LED module in any desired length, also substantially shorter than the length of a tube-shaped fluorescent lamp. The length of a fluorescent lamp (18, 36 & 58 W or their equivalents in other countries) can be accomplished by putting together a plurality of modules. It is also possible to build lamps that then differ substantially from these standard lengths.

Different materials can be used for the heat sink, LED cover or the casting compound. The heat sink is preferably made of metal and has, for example, additional cooling fins. It is likewise possible that the heat sink is built of multiple pieces and in this way has a metal cooling core with cooling fins and a plastic housing that surrounds this core.

Like other protective covers, the LED cover can be manufactured from a corresponding transparent or at least translucent material, such as, for example, borosilicate, temperature-resistant glass or also from a plastic such as polycarbonate or the like.

The LED cover can optionally be coloured in diverse colours and/or coated.

The casting compound can likewise be formed from a corresponding material such as polyurethane resin, epoxide resin, silicone resin or the like. As a rule, the casting compound is a casting resin in which a chemical reaction causes solidification that is irreversible. Corresponding casting resins other than those mentioned above are likewise possible.

BRIEF DESCRIPTION OF THE DRAWINGS

In the following, an advantageous embodiment of the invention is explained using the included figures.

Shown are.

DETAILED DESCRIPTION OF THE EXAMPLE EMBODIMENTS

Figure 1:
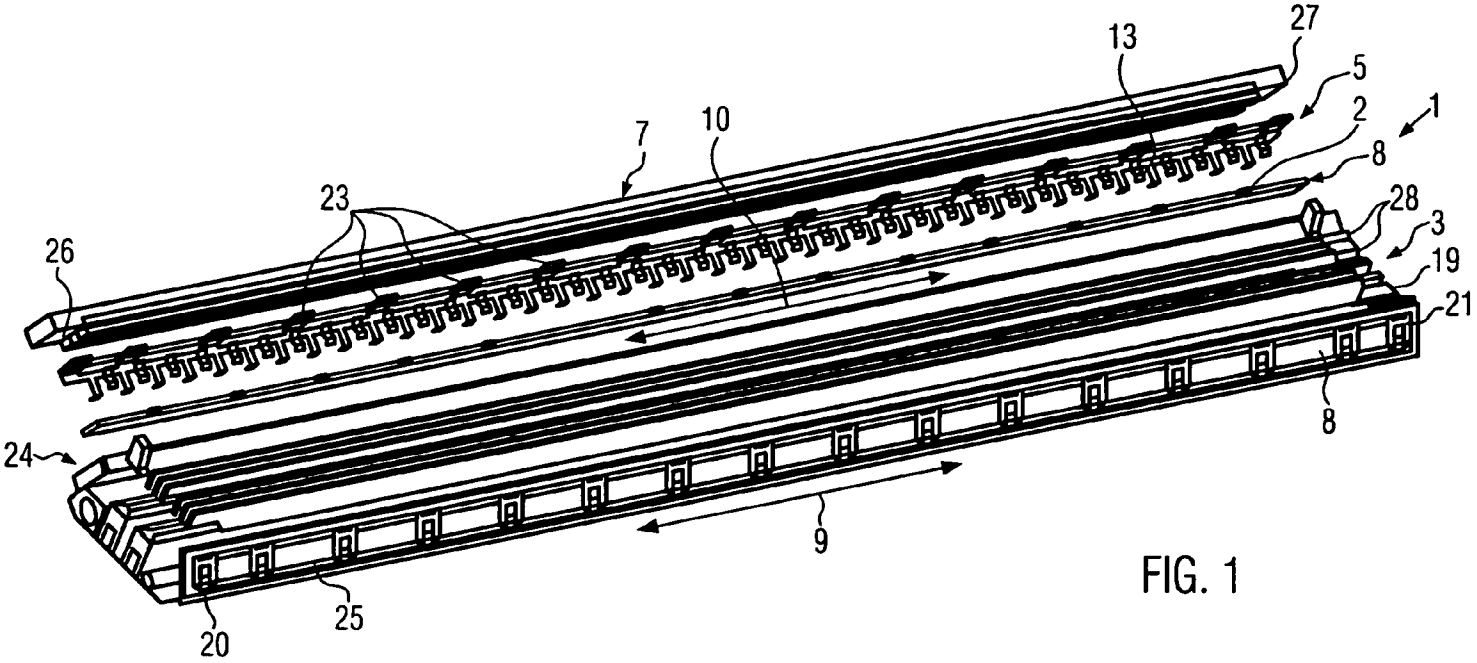
FIG. 1 an embodiment of an LED module according to the invention in a blown-up representation.

FIG. 1 shows a side top view of an exploded representation of an LED module 1 according to the invention. The LED module 1 has a heat sink 3 that extends in the longitudinal direction 10. On both of its side ends 24, 25, see also FIG. 3, LEDs 2 are arranged that are arranged all together on one LED board 8. This extends in the board's longitudinal direction 9 essentially across the entire length of the heat sink 3. Between the side ends 24, 25, the heat sink has a number of cooling fins 28, see also FIGS. 3-5. On the side of the left side end 24 according to FIG. 1, see also FIG. 3, the different individual parts of the LED module are shown in an exploded view. For example, the LED board 8 with a plurality of LEDs 2 is visible, above which a corresponding LED cover 5 is arranged, and a casting compound 7 is arranged above this. All of these parts extend essentially across the entire length of the heat sink 3, see also the other side end 25.

Figure 3:
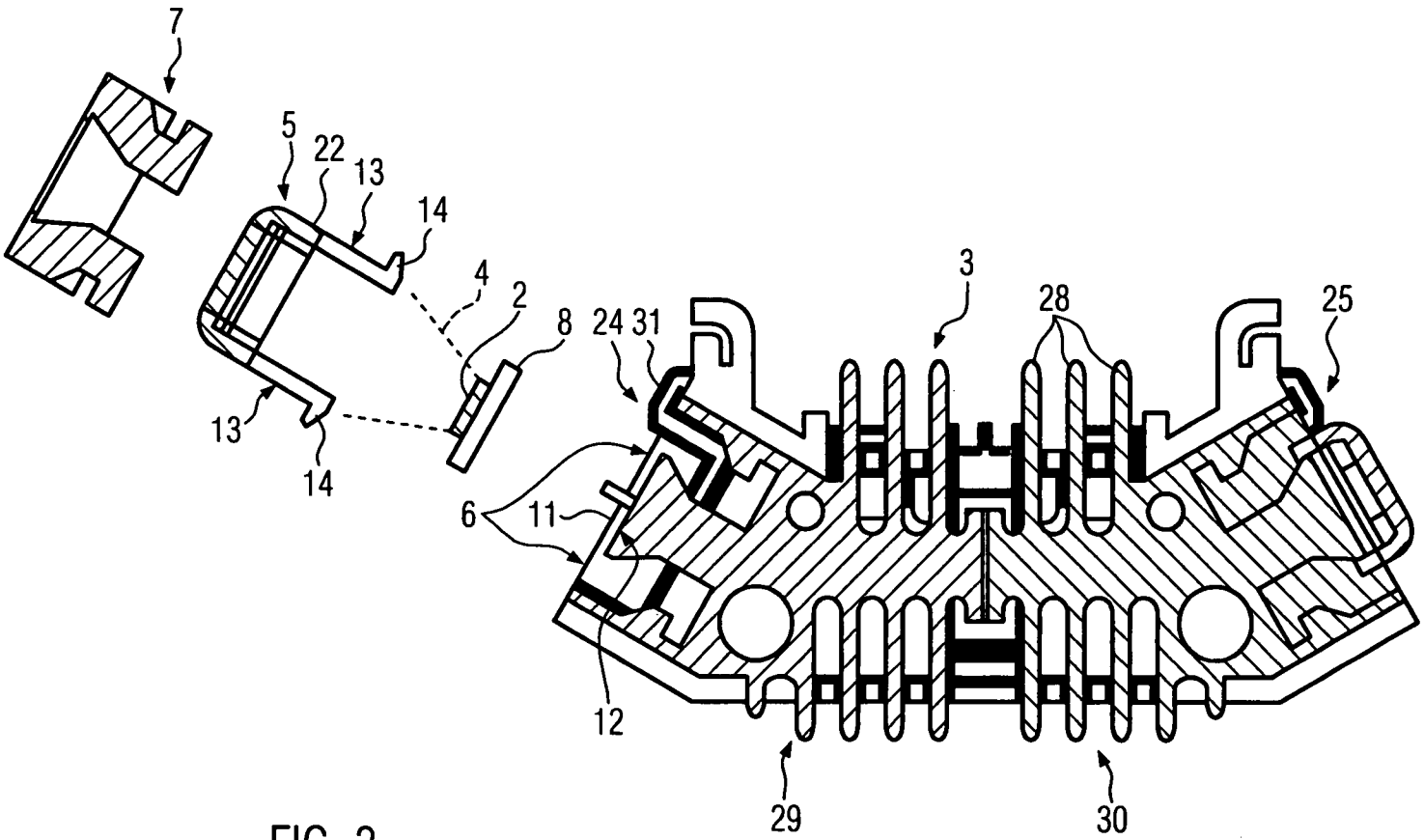
FIG. 3 a cut along the line III-III from FIG. 2 shown in an exploded representation.

The LED board 8 is laid into an inlay recess 11 on the respective side end 24 or 25 and is in contact with a corresponding cooling surface 12, see also FIG. 3. A heat conducting foil, not shown, can also be arranged between the LED board 8 and the cooling surface. The cooling surface 12 extends along the inlay recess 11 and forms its lower end, see FIG. 3 again. Corresponding means can be provided on the cooling surface 11 or assigned to the same, whereby these means fix the LED board 8 in place in a certain relative position or they at least position it. Corresponding devices can also be provided only at the ends of the inlay recess 11 or cooling surface 12.

The inlay recess 11 correspondingly has ends at the ends of the cooling surface 12, see, for example, in FIG. 1 with longitudinal ends 20 and 21 of the LED board 8, in which end sections 26, 27 of the casting compound 7 are arranged.

With regard to FIG. 1, it must be observed that the casting compound 7 is not a separate part but that instead the casting compound is, as a rule, formed from a casting resin that is cast into the inlay recess 11 and also a corresponding insertion recess 6, see the following explanation. There the casting compound 7 hardens and solidifies into a shape according to FIG. 1, see reference number 7 there.

A corresponding cross-section of the hardened casting compound is marked with reference number 7 in FIG. 3, whereby again it is pointed out that this part is not hardened and inserted in this shape, but instead does not take on this corresponding shape until after the casting and hardening of the casting compound.

Figure 4:
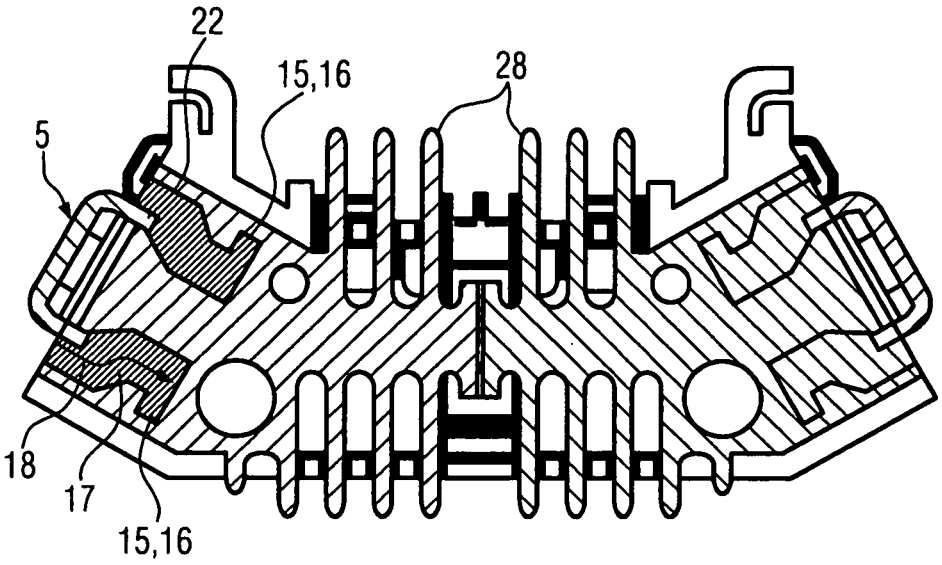
FIG. 4 a sectional view along the line IV-IV from FIG. 2.
Figure 5:
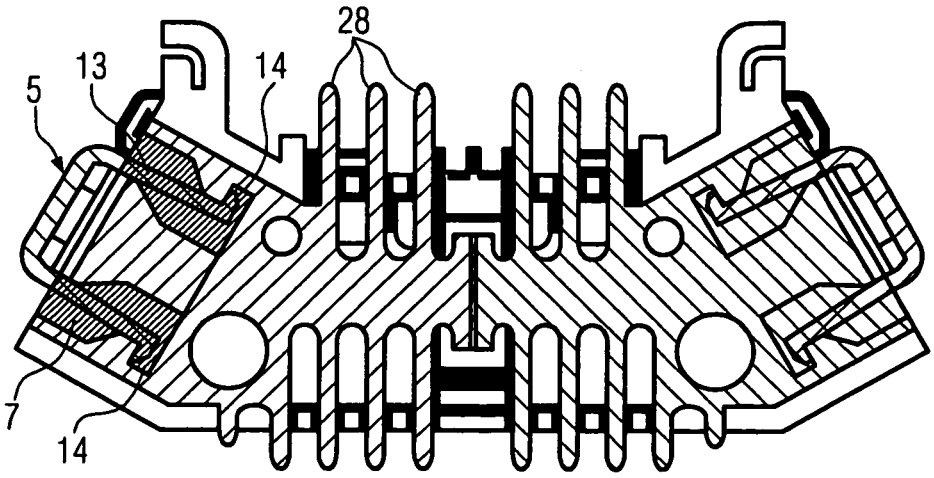
FIG. 5 a sectional view along the line V-V from FIG. 2.

During the casting of the casting compound 7, this forms a shape complementary to the recesses on its underside that faces the insertion recess 6 or the inlay recess 11, see also FIGS. 4 and 5, whereby the casting compound serves to seal the LED cover 5 relative to the heat sink 3 and consequently to seal the LEDs of the LED board 8.

Casting recesses 19 are formed on the corresponding ends of the inlay recess 11, see FIG. 1, whereby the end sections 26 or 27 of the casting compound 7 are arranged in these casting recesses 19.

The LED cover 5 has a multiplicity of insert elements 13 on its underside that faces the insert recess 6, see also FIG. 3. During the arrangement of the LED cover 5 on the heat sink 3, these insert elements 13 are inserted into the insertion recess 6 and there locked into place on the free ends of the insertion elements 13 in corresponding latching recesses 16 by means of the latching elements 14, also see FIGS. 4 and 5. Next to the insertion elements 13, the LED cover 5 has a circumferential edge 22 around the entire circumference that dips into the casting compound 7 when the LED cover 5 is attached to the heat sink 3, also see FIG. 4. The corresponding insertion elements 13 stick out from this circumferential edge 22, see FIG. 1.

Figure 2:
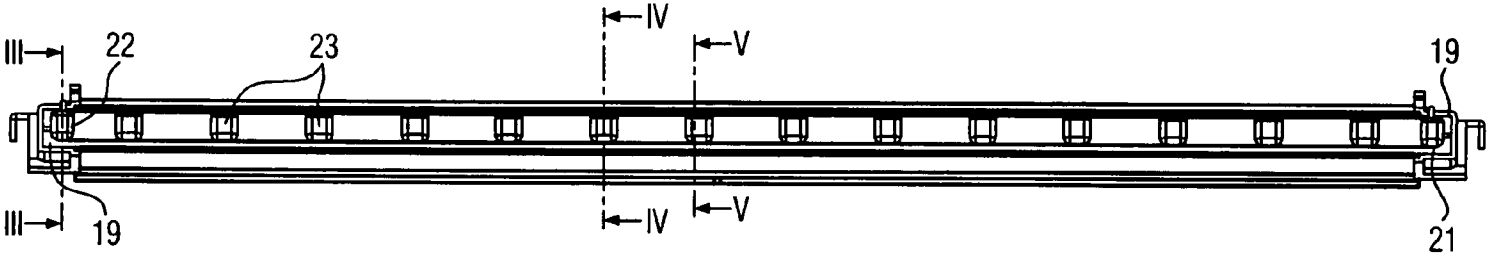
FIG. 2 a side-view of an LED module according to FIG. 1.

FIG. 2 depicts a side view of the LED module 1 according to FIG. 1. In particular, a few cuts are marked that correspond to the following FIGS. 3-5, see the cutting lines III-III, IV-IV and V-V. In FIG. 2 it is particularly evident that the LED cover 5 has a number of LED hook-ups 23, see also FIG. 1, with each one assigned to an LED 2 of the LED board 8. In the depicted embodiment, corresponding LED hook-ups 23 are arranged, for example, on the longitudinal ends 20 or 21 of the LED board 8 in order to cover LEDs 2 that are still situated there. The LED cover 5 is surrounded by the casting compound 7 along its entire circumference, see end sections 26 and 27 and in the casting compound 7 cast into the insertion recess 6. according to FIGS. 3-5.

FIG. 3 corresponds to a sectional view along the line III-III from FIG. 2 in the case of the exploded depiction according to FIG. 1. In this embodiment, the heat sink 3 has mirror-image halves 29, 30 that are detachably connected to each other on their adjacent sides. Each of these halves has a metal inner body with cooling fins 28 that stick out from it. These are arranged in a housing formed, for example, of plastic.

An LED board 8, an LED cover 5 and corresponding casting compound 7 are arranged on each of the side ends 24, 25 of the complete heat sink 3. The LED board 8 is arranged on the cooling surface 12 within the inlay recess 11. The cooling surface 12 is bordered along its longitudinal sides by the insertion recess 6 that extends into the heat sink 3 and that in particular serves to hold the insertion elements 13, see FIG. 5 and at least partially to hold the casting compound 7.

The insertion recess 6 has a cross-section that changes, see also reference number 17 in FIG. 4, whereby as a rule, the cross-section increases from the insertion side, i.e., moving away from the cooling side 12. The cross-section can, however, also get smaller again later and overall the insertion recess 6 can have a development 18, see FIG. 4 again, that changes its direction.

Lower ends of the insertion recess 6 have lateral latching recesses 16 that serve as counter-latching elements 15 for latching elements 14 that are arranged on free ends of the insertion elements 13, see also FIG. 5. In the area between the insertion elements 13, see, for example FIG. 4, the circumferential edge 22 of the LED cover 5 extends into the casting compound 7 that essentially fully fills the insertion recess 6 and essentially leaves only the LED hook-ups 23 free.

Otherwise the LED cover is arranged with its circumferential edge 22 and the insertion elements 13 fully in the casting compound 7.

According to FIG. 3, the corresponding LEDs 2 have a certain emission area or an emission direction 4 that is essentially determined by the corresponding LED hook-ups 23.

It is furthermore pointed out that the casting compound 7, see, for example, FIG. 3, can also leave areas between the LED hook-ups 23 uncovered and in such a case extend only in the circumferential direction around the LED cover 5, see particularly insertion recess 6 and inlay recess 11, with casting recesses 19 at the edge side, see FIG. 1 or 2 again.

FIG. 3 additionally depicts an electric supply line 31 that is introduced into the insertion recess 6 in the area of a longitudinal end of the LED board 8 for electrical contacting of the LED board 8. This is also sealed by the casting compound 7 in a manner similar to that for the LED cover 5.

FIGS. 4 and 5 show further cross-sections along the lines IV-IV and V-V according to FIG. 2, see however also FIG. 1.

In FIG. 4, particularly the LED cover 5 is shown in a sectional view between corresponding insertion elements 13, whereby the circumferential edge 22 dips into the casting compound 7.

FIG. 5 depicts the LED cover 5 in the area of an insertion element 13 with latching element 14, whereby this essentially extends up to the base of the insertion recess 6 and there engages with a counter latching element 15 in the form of a latching recess 16.

The assembly of the LED module is described in the following.

In a first step, the heat sink 3 is optionally put together from two halves 29, 30, see FIG. 3, and these halves are connected to each other. Subsequently the LED board 8 is placed along the cooling surface 12, with heat-conducting foil arranged in between. For temporarily fixing the LED board 8 in place, the LED cover 5 is placed in a next step, whereby the insertion elements 13 of the same engage in the insertion recess 6.

By the exertion of a corresponding pressure on the LED cover 5, its insertion elements 13 are introduced into the insertion recess 6 so far that finally the latching elements 14 latch with the latching recess 16 as a counter-latching element 15, see also FIG. 5. After this the casting compound 7 is cast into the insertion recess 6 and also, on the longitudinal ends 20, 21 of the LED board 8 or of the LED cover 5, into the corresponding casting recesses 19 of the inlay recess 11.

Due to the special arrangement of the LED board with LEDs and LED cover 5, a corresponding free space remains between the LEDs and the LED cover due to the diving bell principle. This means that a cover for the LEDs that is safe from flooding forms.

After the hardening of the casting compound 7, the LED module 1 is ready for use, whereby all LEDs can also be operated in an explosive atmosphere due to the sealing by way of the casting compound and the corresponding cooling of each LED.

The invention claimed is:

1. An explosion-proof LED module, comprising:

at least one light-emitting diode (LED);

a heat sink connected to the at least one LED; and an LED cover that covers the at least one LED at least in an emission direction, wherein the LED cover extends into an insertion recess of the heat sink and is surrounded in the insertion recess by a casting compound resulting in sealing of the at least one LED relative to an outer and possibly explosive atmosphere, wherein the LED cover has a circumferential edge, particularly around an entire circumference, that sticks up in a direction of the insertion recess of the heat sink and wherein the LED cover has a number of insertion elements that stick out from the circumferential edge, wherein the heat sink has an inlay recess running at least in a longitudinal direction of the heat sink, and wherein an LED board is laid onto a cooling surface in the inlay recess, the explosion-proof LED module to replace a tube-shaped fluorescent lamp.

2. The explosion-proof LED module according to claim 1, wherein the at least one LED is a single LED or a plurality of LEDs arranged on the LED board next to one another and spaced apart from one another in a longitudinal direction of the LED board.

3. The explosion-proof LED module according to claim 1, wherein the LED cover covers all LEDs of the LED board and wherein the LED cover is a single piece.

4. The explosion-proof LED module according to claim 1, wherein the heat sink is formed for all LEDs of the LED board and in particular is formed as one piece or from a plurality of segments.

5. The explosion-proof LED module according to claim 1, wherein the cooling surface is encircled by the insertion recess in the longitudinal direction of the heat sink on both sides at least in places.

6. The explosion-proof LED module according to claim 1, wherein the insertion elements of the LED cover stick out in the direction of the insertion recess for attachment to the heat sink.

7. The explosion-proof LED module according to claim 6, wherein the insertion elements are formed with latching elements which engage with counter-latching elements within the insertion recess.

8. The explosion-proof LED module according to claim 7, wherein the counter-latching elements are formed by a corresponding number of latching recesses or at least by one latching recess that stick/sticks out essentially perpendicularly to the heat sink's longitudinal direction.

9. The explosion-proof LED module according to claim 8, wherein the insertion recess has a varying cross-section in a direction of the counter-latching element and/or a direction-changing development.

10. The explosion-proof LED module according to claim 1, wherein a casting recess is formed on longitudinal ends of the LED board in the heat sink.

11. The explosion-proof LED module according to claim 1, wherein the LED cover has at least one LED hook-up convexly curved away from the at least one LED, wherein each LED hook-up of the at least one LED hook-up is assigned to a respective LED of the at least one LED.

12. The explosion-proof LED module according to claim 11, wherein the at least one LED hook-up is formed as a lens system for the at least one LED or comprises such a system.

13. The explosion-proof LED module according to claim 1, wherein the heat sink has two lateral side ends transverse to the longitudinal direction of the heat sink and running at a tilt relative to a vertical, and wherein a respective structure comprising the LED board, the LED cover and the casting compound is arranged on each lateral side.

14. The explosion-proof LED module according to claim 1, wherein the heat sink is put together from two or more parts.

15. The explosion-proof LED module according to claim 1, wherein the LED cover covers all LEDs of the LED board and wherein the LED cover is multiple pieces.

* * * * *